US009004793B2

(12) United States Patent
Huang

(10) Patent No.: US 9,004,793 B2
(45) Date of Patent: Apr. 14, 2015

(54) LIPSTICK CASE LIPSTICK BODY LIFT SEAT ANTI-SLIPPED STRUCTURE

(71) Applicant: Chin-Ming Huang, Changhua County (TW)

(72) Inventor: Chin-Ming Huang, Changhua County (TW)

( * ) Notice: Subject to any disclaimer, the term of this patent is extended or adjusted under 35 U.S.C. 154(b) by 263 days.

(21) Appl. No.: 13/757,832

(22) Filed: Feb. 3, 2013

(65) Prior Publication Data

US 2014/0219704 A1 Aug. 7, 2014

(51) Int. Cl.

| | |
|---|---|
| ***A45D 40/06*** | (2006.01) |
| ***A45D 40/12*** | (2006.01) |
| ***A45D 40/02*** | (2006.01) |
| ***A45D 40/04*** | (2006.01) |

(52) U.S. Cl.
CPC ..... *A45D 40/12* (2013.01); *A45D 40/02* (2013.01); *A45D 40/04* (2013.01)

(58) Field of Classification Search
USPC ..... 401/55, 68, 71, 74, 75, 77, 78, 84, 87, 401/116
See application file for complete search history.

(56) References Cited

U.S. PATENT DOCUMENTS

| | | | | | |
|---|---|---|---|---|---|
| 1,695,407 | A * | 12/1928 | Anderson | ..... | 401/74 |
| 1,695,625 | A * | 12/1928 | Wild | ..... | 401/74 |
| 2,354,136 | A * | 7/1944 | Morey | ..... | 401/71 |
| 2,704,598 | A * | 3/1955 | Casey | ..... | 401/78 |
| 3,298,509 | A * | 1/1967 | Hultgren | ..... | 401/78 |
| 3,623,822 | A * | 11/1971 | Davidson | ..... | 401/78 |
| 5,143,464 | A * | 9/1992 | Susini et al. | ..... | 401/78 |
| 5,302,042 | A * | 4/1994 | Ackermann | ..... | 401/74 |
| 6,102,599 | A * | 8/2000 | Pierpont | ..... | 401/78 |
| 6,200,049 | B1 * | 3/2001 | Pinhel et al. | ..... | 401/78 |
| 6,412,999 | B1 * | 7/2002 | Pierpont | ..... | 401/74 |
| 8,905,665 | B2 * | 12/2014 | Chang | ..... | 401/84 |
| 2008/0304897 | A1 * | 12/2008 | Rosenblatt | ..... | 401/78 |

* cited by examiner

*Primary Examiner* — David Walczak
*Assistant Examiner* — Bradley Oliver
(74) *Attorney, Agent, or Firm* — Che-Yang Chen; Law Office of Michael Chen

(57) ABSTRACT

A lipstick case lipstick body lift seat anti-slipped structure includes a lipstick case, an outer tube, a lift seat with an opening facing upward, and a lipstick body. A plurality of anti-slipped blocking grooves is formed on an upwardly inclined side of each of the two inclined guiding grooves. The outer tube is sleeved on an outer side of the small diameter guiding tube, and a spiral guiding groove is disposed on an inner wall of the outer tube concavely. The lipstick body is sleeved in the lift seat. Two lift guiding columns are disposed on an outer wall of the lift seat protrudingly for engaging with the inclined guiding grooves correspondingly and pressing into the spiral guiding groove. An anti-slipped blocking portion is protrudingly disposed on an outer diameter of each of the lift guiding columns corresponding to the anti-slipped blocking grooves.

3 Claims, 5 Drawing Sheets

PRIOR ART

LIPSTICK CASE LIPSTICK BODY LIFT SEAT ANTI-SLIPPED STRUCTURE

BACKGROUND OF THE INVENTION

1. Field of Invention

The invention relates to an anti-slipped structure for a lipstick case and more particularly to a lipstick case lipstick body lift seat anti-slipped structure which can prevent a lipstick body loaded in a lift seat from slipping downward when a force is exerted during usage and provide steadiness when being used.

2. Background

Please refer to FIG. 1, which is a perspective view of a conventional lipstick case structure. A lipstick case 10 includes a lipstick case body 11, a smaller diameter guiding tube 111 is disposed on an upper section of the lipstick case body 11, and two lift dissected grooves 112 are disposed on the smaller diameter guiding tube 111. An outer tube 12 with two oppositely and concavely disposed spiral guiding grooves 121 on an inner wall of the outer tube 12 is sleeved on an outer side of the smaller diameter guiding tube 111 correspondingly. Two lift guiding columns 131 are protrudingly disposed on an outer wall of a lift seat 13 with an opening facing upward. The lift guiding columns 131 are sleeved into the lift dissected grooves 112 and engaged into the spiral guiding grooves 121. A lipstick body 14 is sleeved in the upwardly faced opening of the lift seat 13. When the lipstick case body 11 is turned and the lift guiding columns 131 of the lift seat 13 are driven by the lift dissected grooves 112 to move upward and downward in the spiral guiding grooves 121, the lipstick body 14 is carried by lift seat 13.

Conventional cleaning structures for absorbing and cleaning floating oil and substance on water surface are usually structurally formed as cleaning balls made of sponge material. Irregular holes inside the sponge are used for absorbing dirt floating on water surface.

However, in FIG. 1, no anti-slipped structure is disposed on the lift guiding columns 131 of the lift seat 13, the lift dissected grooves 112 and the spiral guiding grooves 121 for preventing the lift seat 13 from slipping downward. Therefore, when the exposed lipstick body 14 at an upper end of the lipstick case 10 is pressed by a downward pressure, the lift seat 13 with the loaded lipstick body 14 will slip downward along the lift dissected grooves 112 and the spiral guiding grooves 121 as indicated by an arrow in FIG. 1. The lipstick body 14 cannot be positioned securely and may be missed while slipping downward and it has to be pushed upward again and again. It is very convenient for users and is a major disadvantage of the conventional lipstick case structure.

SUMMARY

Therefore, a lipstick case lipstick body lift seat anti-slipped structure of the invention is provided for solving the problems of downward slipping and inconvenience of conventional lipstick case structures during usage.

An embodiment of the invention is to provide a lipstick case lipstick body lift seat anti-slipped structure for preventing a lipstick body loaded in a lift seat from slipping downward when a force is exerted during usage and providing steadiness when being used.

A further embodiment of the invention is to provide a lipstick case lipstick body lift seat anti-slipped structure for preventing downward slipping and providing steadiness during usage without having to add other parts and accessories to existing structure, and at the same time, costs can be controlled effectively and economic effectiveness can be achieved.

In one example, a lipstick case lipstick body lift seat anti-slipped structure of an embodiment of the invention includes a lipstick case, a small diameter guiding tube is disposed on an upper section of the lipstick case, two longitudinally and oppositely disposed inclined guiding grooves are dissected on a wall of the small diameter guiding tube, a plurality of anti-slipped blocking grooves is formed on an upwardly inclined side of each of the two inclined guiding grooves; an outer tube with a spiral guiding groove concavely disposed on an inner wall of the outer tube is sleeved on an outer side of the small diameter guiding tube; and a lift seat with an upwardly faced opening is provided for a lipstick body to sleeve into. Two lift guiding columns are disposed on an outer wall of the lift seat protrudingly for engaging with the inclined guiding grooves correspondingly and pressing into the spiral guiding groove for driving the lift seat upward and downward spirally. An anti-slipped blocking portion is protrudingly disposed on an outer diameter of each of the lift guiding columns corresponding to the anti-slipped blocking grooves for preventing downward slipping.

The anti-slipped blocking grooves are a plurality of right-angled cascade structures arranged on the upwardly inclined sides.

The anti-slipped blocking portions are right-angled tapering structures.

The invention will become more fully understood by reference to the following detailed description thereof when read in conjunction with the attached drawings.

DETAILED DESCRIPTION

Figure 1:
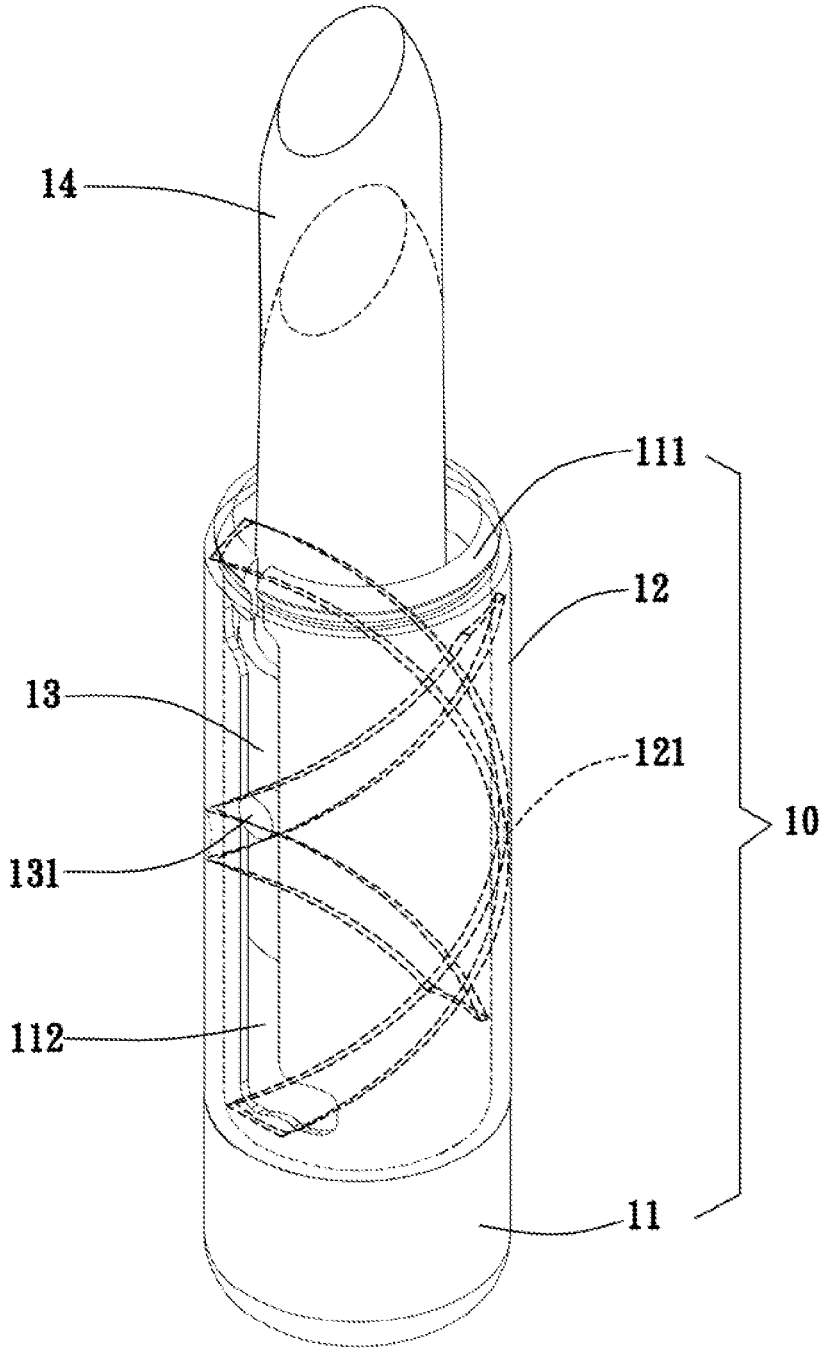
FIG. 1 is a perspective view of a conventional lipstick case structure.
Figure 2:
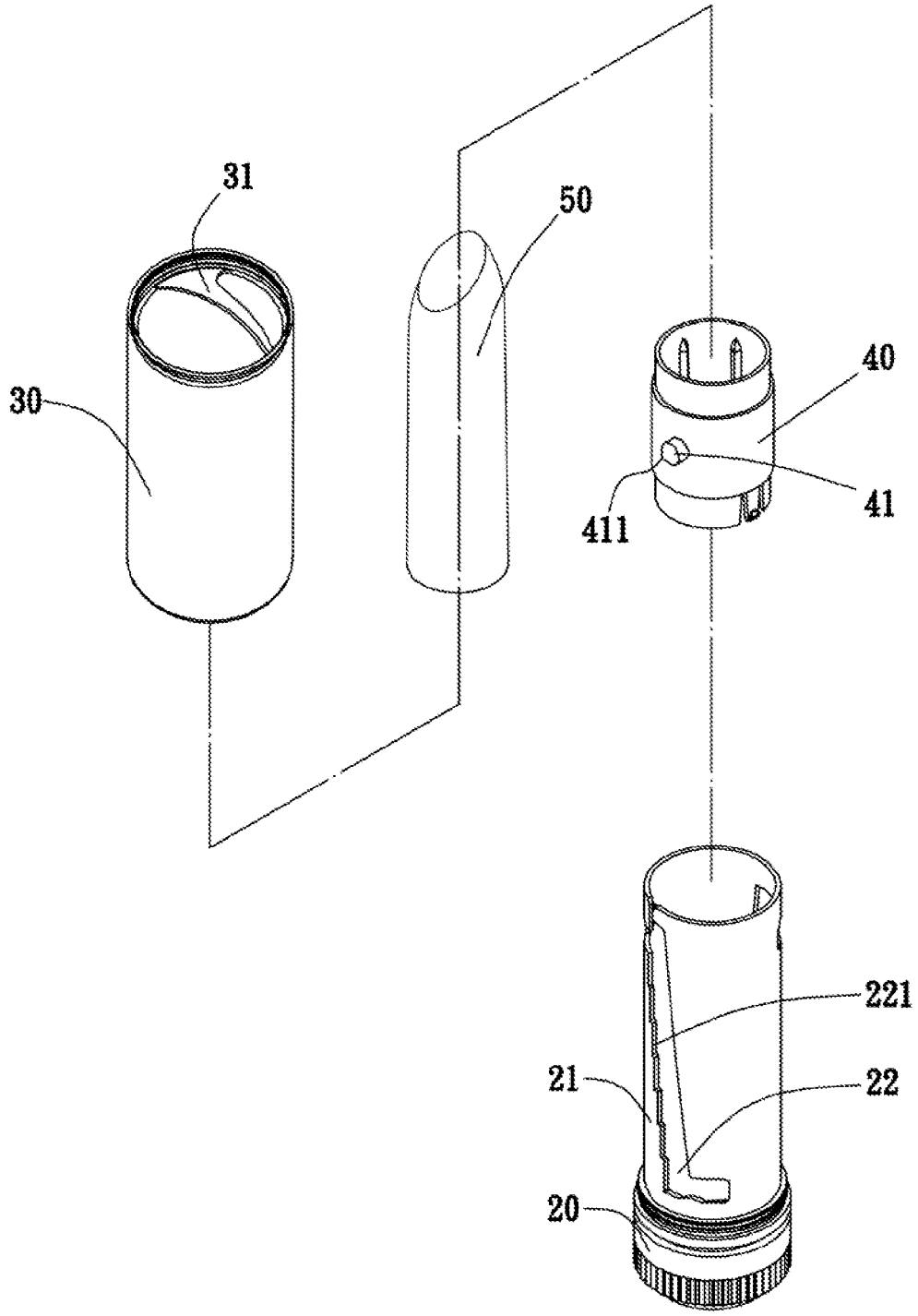
FIG. 2 is a perspective exploded view of a lipstick case lipstick body lift seat anti-slipped structure of an embodiment of the invention.

Please refer to FIG. 2, which is a perspective exploded view of a lipstick case lipstick body lift seat anti-slipped structure of an embodiment of the invention. The lipstick case lipstick body lift seat anti-slipped structure includes a lipstick case 20, an outer tube 30, a lift seat 40 and a lipstick body 50.

A small diameter guiding tube 21 is disposed on an upper section of the lipstick case 20, and two longitudinally and oppositely disposed inclined guiding grooves 22 are dissected on the small diameter guiding tube 21. A plurality of right-angled cascade structured anti-slipped blocking grooves 221 is formed and arranged on an upwardly inclined side of each of the two inclined guiding grooves 22.

The outer tube 30 is sleeved on an outer side of the small diameter guiding tube 21, and a spiral guiding groove 31 is disposed on an inner wall of the outer tube 30 concavely corresponding to the inclined guiding grooves 22.

The lift seat 40 is a seat with an opening facing upward. Two lift guiding columns 41 are disposed on an outer wall of the lift seat 40 protrudingly. A right-angled tapering structured anti-slipped blocking portion 411 is protrudingly disposed on an outer diameter of each of the lift guiding columns 41 at a bottom end facing the anti-slipped blocking grooves 221.

A bottom end of the lipstick body 50 is sleeved inside the lift seat 40 for engaging with an engage portion.

The lift seat 40 with lipstick body 50 sleeved inside is sleeved inside the small diameter guiding tube 21 of the lipstick case 20. The two lift guiding columns 41 on the outer wall of the lift seat 40 are engaged with the inclined guiding grooves 22 correspondingly and pressed into the spiral guiding groove 31. Because the lift guiding columns 41 are engaged in the spiral guiding groove 31, the lift seat 40 can be driven by the spiral guiding groove 31 of the outer tube 30 to move upward and downward inside the inclined guiding grooves 22 as shown on FIG. 3.

Figure 3:
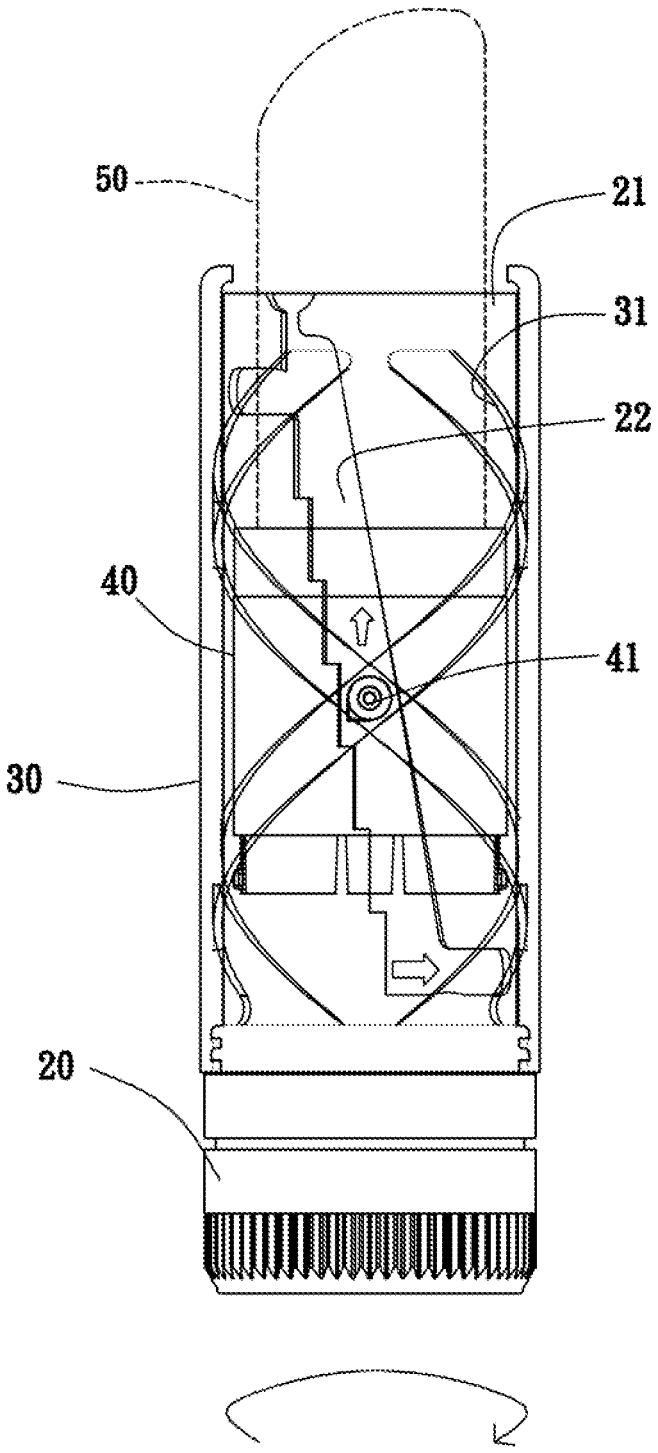
FIG. 3 is a first flat assembled view of the lipstick case lipstick body lift seat anti-slipped structure of an embodiment of the invention.

Please refer to FIG. 3, which shows how the lipstick case lipstick body lift seat anti-slipped structure of an embodiment of the invention is driven upward. When the outer tube 30 is held and a bottom end of the lipstick case 20 is turned at a direction indicated by an arrow in FIG. 3, the lift guiding columns 41 of the lift seat 40 are pressed against by the upwardly inclined sides of the two inclined guiding grooves 22 disposed with the anti-slipped blocking grooves 221 to move upward in the spiral guiding groove 31 to reach a position shown in FIG. 4, and the lipstick body 50 loaded in the lift seat 40 is lifted upward to a position for usage.

Figure 4:
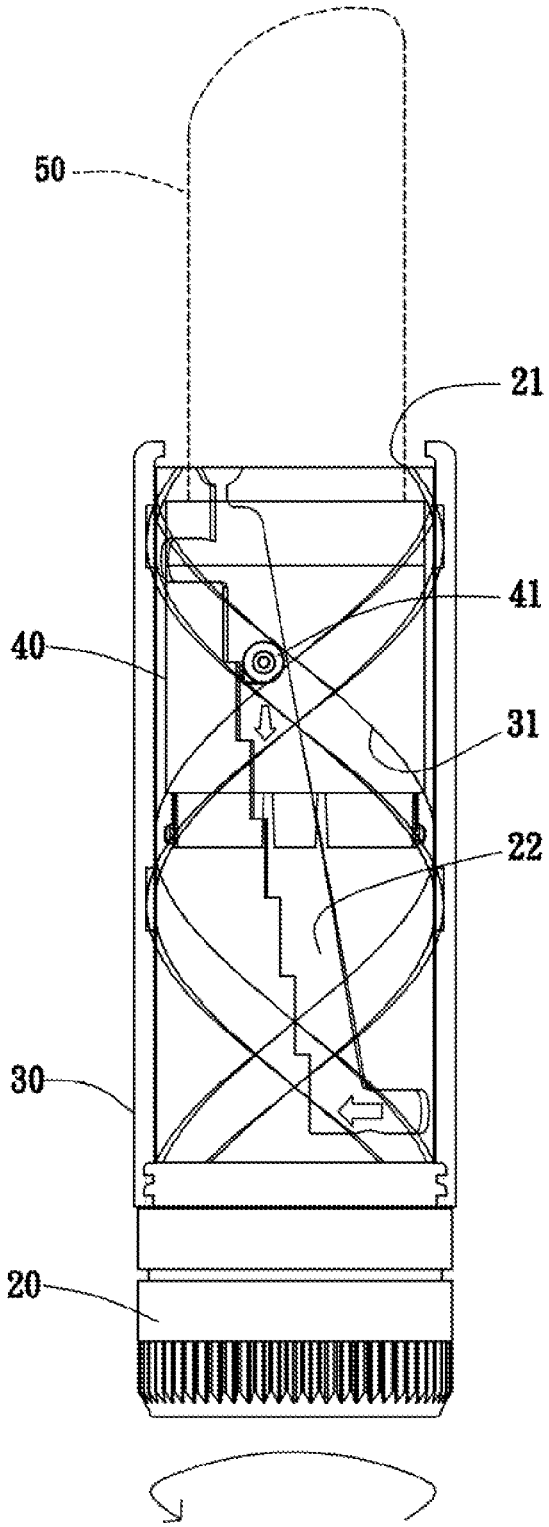
FIG. 4 is a second flat assembled view of the lipstick case lipstick body lift seat anti-slipped structure of an embodiment of the invention.

Please refer to FIG. 4, which shows how the lipstick case lipstick body lift seat anti-slipped structure of an embodiment of the invention is driven downward. When the bottom end of the lipstick case 20 is turned at an opposite direction indicated by an arrow in FIG. 4, the lift guiding columns 41 of the lift seat 40 are driven by downwardly inclined sides of the two inclined guiding grooves 22 to move downward in the spiral guiding groove 31 to reach a position shown in FIG. 3, and the lipstick body 50 loaded in the lift seat 40 is descended downward to a retracted position.

Figure 5:
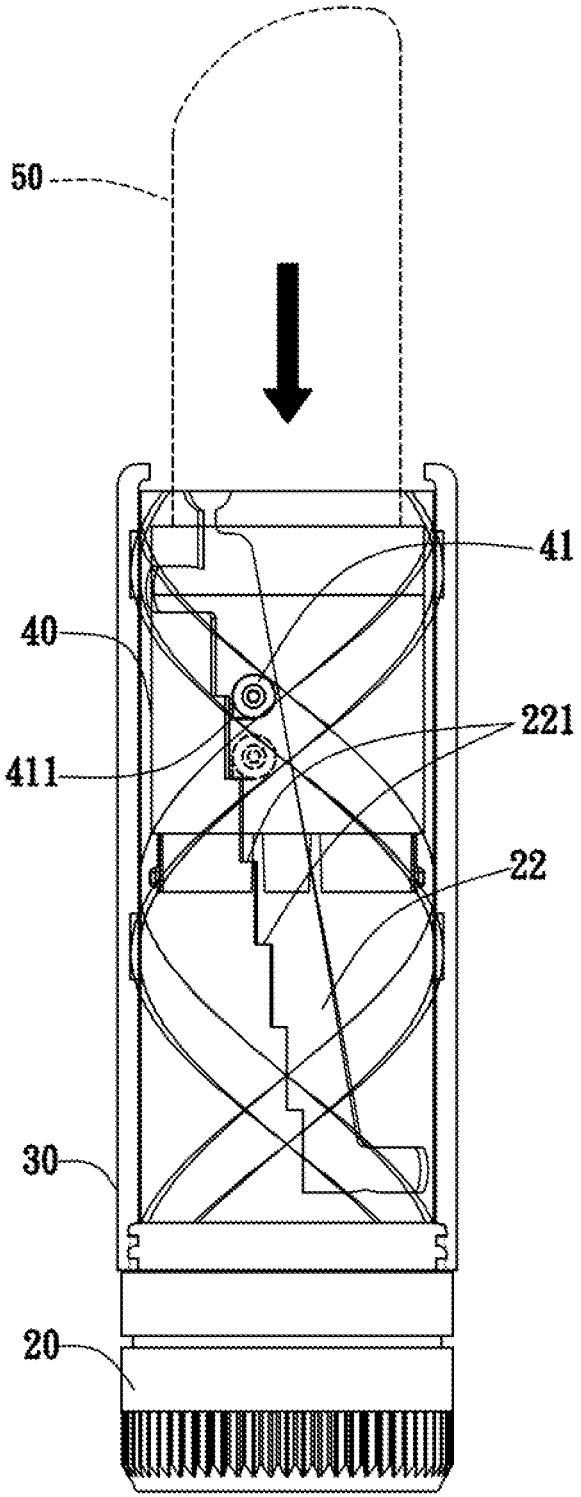
FIG. 5 is a schematic view of the lipstick case lipstick body lift seat anti-slipped structure of the invention being stopped from slipping downward during usage according to an embodiment of the invention.

Please refer to FIG. 5, which shows how the lipstick case lipstick body lift seat anti-slipped structure of the invention is stopped from slipping downward from a position during usage according to an embodiment of the invention. By using the anti-slipped blocking grooves 221 disposed on the upwardly inclined sides of the inclined guiding grooves 22, and the anti-slipped blocking portions 411 protrudingly disposed on the lift guiding columns 41 of the lift seat 40 corresponding to the anti-slipped blocking grooves 221; when the lipstick body 50 pushed upward by the lift seat 40 is pressed against by a pressure in a direction indicated by an arrow in FIG. 5, the anti-slipped blocking portions 411 of the lift guiding columns 41 will be pressed against and prevented from slipping downward by the nearest anti-slipped blocking groove 221 as shown by a dotted line. Thereby, the lipstick body 50 can be supported effectively and steadiness can be provided during usage.

According to the lipstick case lipstick body lift seat anti-slipped structure, by using the anti-slipped blocking portions of the lift guiding columns and the anti-slipped blocking grooves of the lipstick case for stopping and positioning the anti-slipped blocking portions, the lipstick body can be prevented from slipping downward without having to add other parts and accessories to existing structure. Thereby, costs can be controlled effectively and economic effectiveness can be achieved.

Note that the specifications relating to the above embodiments should be construed as exemplary rather than as limitative of the invention, with many variations and modifications being readily attainable by a person of average skill in the art without departing from the spirit or scope thereof as defined by the appended claims and their legal equivalents.

What is claimed is:

1. A lipstick case lipstick body lift seat anti-slipped structure, comprising:

a lipstick case;

a small diameter guiding tube being disposed on an upper section of the lipstick case;

two longitudinally and oppositely disposed inclined guiding grooves being dissected on a wall of the small diameter guiding tube;

a plurality of anti-slipped blocking grooves being formed on an upwardly inclined side of each of the two inclined guiding grooves;

an outer tube with a spiral guiding groove concavely disposed on an inner wall of the outer tube being sleeved on an outer side of the small diameter guiding tube;

a lift seat with an upwardly faced opening being provided for a lipstick body to sleeve into;

two lift guiding columns being disposed on an outer wall of the lift seat protrudingly for engaging with the inclined guiding grooves correspondingly and pressing into the spiral guiding groove for driving the lift seat upward and downward spirally; and an anti-slipped blocking portion being protrudingly disposed on an outer diameter of each of the lift guiding columns corresponding to the anti-slipped blocking grooves for preventing downward slipping.

2. The lipstick case lipstick body lift seat anti-slipped structure as claimed in claim 1, wherein the plurality of anti-slipped blocking grooves comprise a plurality of right-angled cascade structures arranged on the upwardly inclined sides.

3. The lipstick case lipstick body lift seat anti-slipped structure as claimed in claim 1, wherein the anti-slipped blocking portion comprises a right-angled tapering structure.

* * * * *